US007835672B2

(12) United States Patent
Sakamoto et al.

(10) Patent No.: US 7,835,672 B2
(45) Date of Patent: Nov. 16, 2010

(54) DEVELOPING DEVICE, IMAGE CARRIER UNIT AND IMAGE FORMING APPARATUS

(75) Inventors: Takashi Sakamoto, Ebina (JP); Kei Hirata, Ebina (JP); Akihide Kawamura, Ebina (JP); Naoya Iwata, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 279 days.

(21) Appl. No.: 12/042,376

(22) Filed: Mar. 5, 2008

(65) Prior Publication Data

US 2008/0260430 A1 Oct. 23, 2008

(30) Foreign Application Priority Data

Apr. 19, 2007 (JP) ..... 2007-110640

(51) Int. Cl.
*G03G 15/08* (2006.01)

(52) U.S. Cl. ..... 399/254; 399/256; 399/262; 399/263

(58) Field of Classification Search ..... 399/107, 399/119, 120, 252–254, 262, 263, 255, 256
See application file for complete search history.

(56) References Cited

U.S. PATENT DOCUMENTS 7,231,154 B2 * 6/2007 Sakamaki ..... 399/27
7,426,360 B2 * 9/2008 Arimoto et al. ..... 399/254
2005/0214001 A1 9/2005 Sakamaki

FOREIGN PATENT DOCUMENTS

JP 2001-166593 A 6/2001
JP 2005-283685 A 10/2005

* cited by examiner

*Primary Examiner*—Hoan Tran
(74) *Attorney, Agent, or Firm*—Sughrue Mion, PLLC

(57) ABSTRACT

A developing device includes a first developer containing chamber, a second developer containing chamber, a first inflow section, a second inflow section, a first conveyance member and a second conveyance member. The first inflow section allows the developer to flow from the second developer containing chamber into the first developer containing chamber. The second inflow section allows the developer to flow from the first developer containing chamber into the second developer containing chamber. The first conveyance member conveys the developer contained in the first developer containing chamber in a first developer conveyance direction. The second conveyance member conveys the developer contained in the second developer containing chamber in a second developer conveyance direction. In a range corresponding to the first inflow section, an area of a cross section, perpendicular to the second developer conveyance direction, of the second developer containing chamber decreases along the second developer conveyance direction.

19 Claims, 11 Drawing Sheets

DEVELOPING DEVICE, IMAGE CARRIER UNIT AND IMAGE FORMING APPARATUS

CROSS-REFERENCE TO RELATED APPLICATIONS

This application is based on and claims priority under 35 U.S.C. §119 from Japanese Patent Application No. 2007-110640 filed on Apr. 19, 2007.

BACKGROUND

1. Technical Field

The invention relates to a developing device, an image carrier unit having the developing device and an image forming apparatus.

2. Summary

According to an aspect of the invention, a developing device includes a developer carrier, a first developer containing chamber, a second developer containing chamber, a first inflow section, a second inflow section, a first conveyance member and a second conveyance member. The developer carrier rotates while carrying a developer on a surface thereof. The first developer containing chamber contains the developer to be supplied to the developer carrier. The second developer containing chamber has a bottom face disposed at a position lower, in a gravitational direction, than a bottom face of the first developer containing chamber. The first inflow section allows the developer to flow from the second developer containing chamber into the first developer containing chamber. The second inflow section allows the developer to flow from the first developer containing chamber into the second developer containing chamber. The first conveyance member is disposed in the first developer containing chamber and conveys the developer contained in the first developer containing chamber in a first developer conveyance direction going from the first inflow section toward the second inflow section. The second conveyance member that is disposed in the second developer containing chamber and conveys the developer contained in the second developer containing chamber in a second developer conveyance direction going from the second inflow section toward the first inflow section. The second developer containing chamber is formed so that in a range corresponding to the first inflow section, an area of a cross section, perpendicular to the second developer conveyance direction, of the second developer containing chamber decreases along the second developer conveyance direction.

BRIEF DESCRIPTION OF THE DRAWINGS

Exemplary embodiments of the invention will be described in detail below with reference to the accompanying drawings, wherein:

FIG. 4 is an explanatory diagram illustrating the entire configuration of the developing device according to Example 1 of the invention.

FIG. 6 is an enlarged view illustrating a rear end portion of the developing device.

FIG. 8 is an explanatory diagram illustrating a developing device according to Example 2 of the invention.

FIG. 9 is an explanatory diagram illustrating a developing device according to Example 3 of the invention.

FIG. 10 is an explanatory diagram illustrating a developing according to Example 4 of the invention.

DETAILED DESCRIPTION

Figure 1:
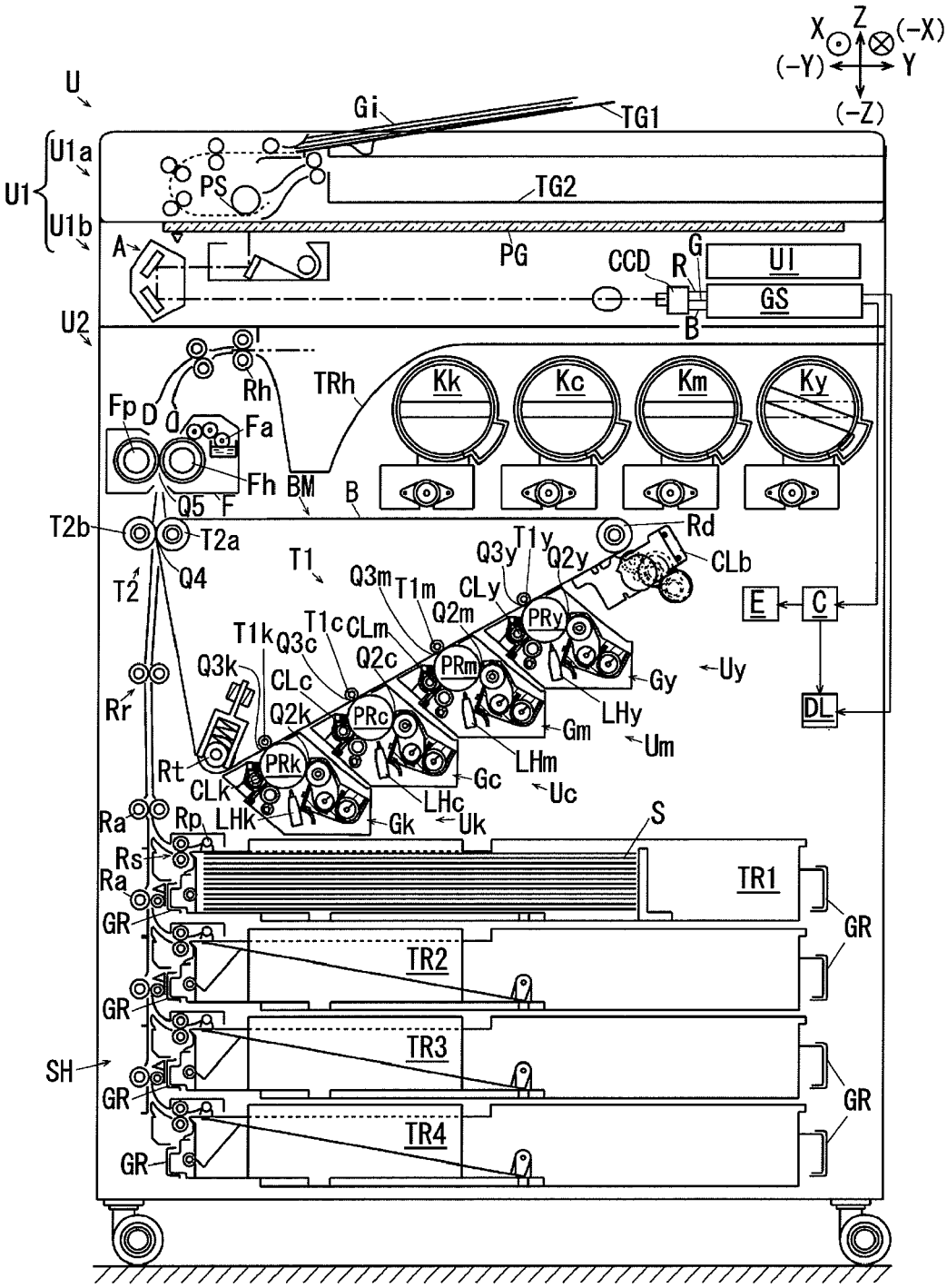
FIG. 1 is an explanatory diagram illustrating the entire configuration of an image forming apparatus including a developing device according to Example 1 of the invention.

Next, specific examples (hereinafter, referred to as "examples") according to an exemplary embodiment of the invention will be described with reference to the drawings. However, the invention is not limited thereto.

In order to facilitate to understand the following description, in the drawings, a front and rear direction is defined as an X axial direction; a right and left direction is defined as a Y axial direction; an up and down direction is defined as a Z axial direction; and directions represented by arrows X, −X, Y, −Y, Z, and −Z are defined as a front direction, a rear direction, a right direction, a left direction, an upward direction, and a downward direction, or a front side, a rear side, a right side, a left side, an upper side, and a lower side, respectively. In addition, a reference sign represented by '•' included in 'O' is defined as an arrow that represents a direction from the rear side of paper toward the front side thereof, and a reference sign represented by 'x' included in 'O' is defined as an arrow that represents a direction from the front side of paper toward the rear side thereof.

In the description with reference to the drawings, members other than those necessary for the description may be omitted in the drawings in order to facilitate to understand the description. In the description of Example 1, a direction in which a paper feeding tray (which will be described later) is detached is defined as the front and rear direction.

EXAMPLE 1

FIG. 1 is an explanatory diagram illustrating the entire configuration of an image forming apparatus including a developing device according to Example 1 of the invention.

Figure 2:
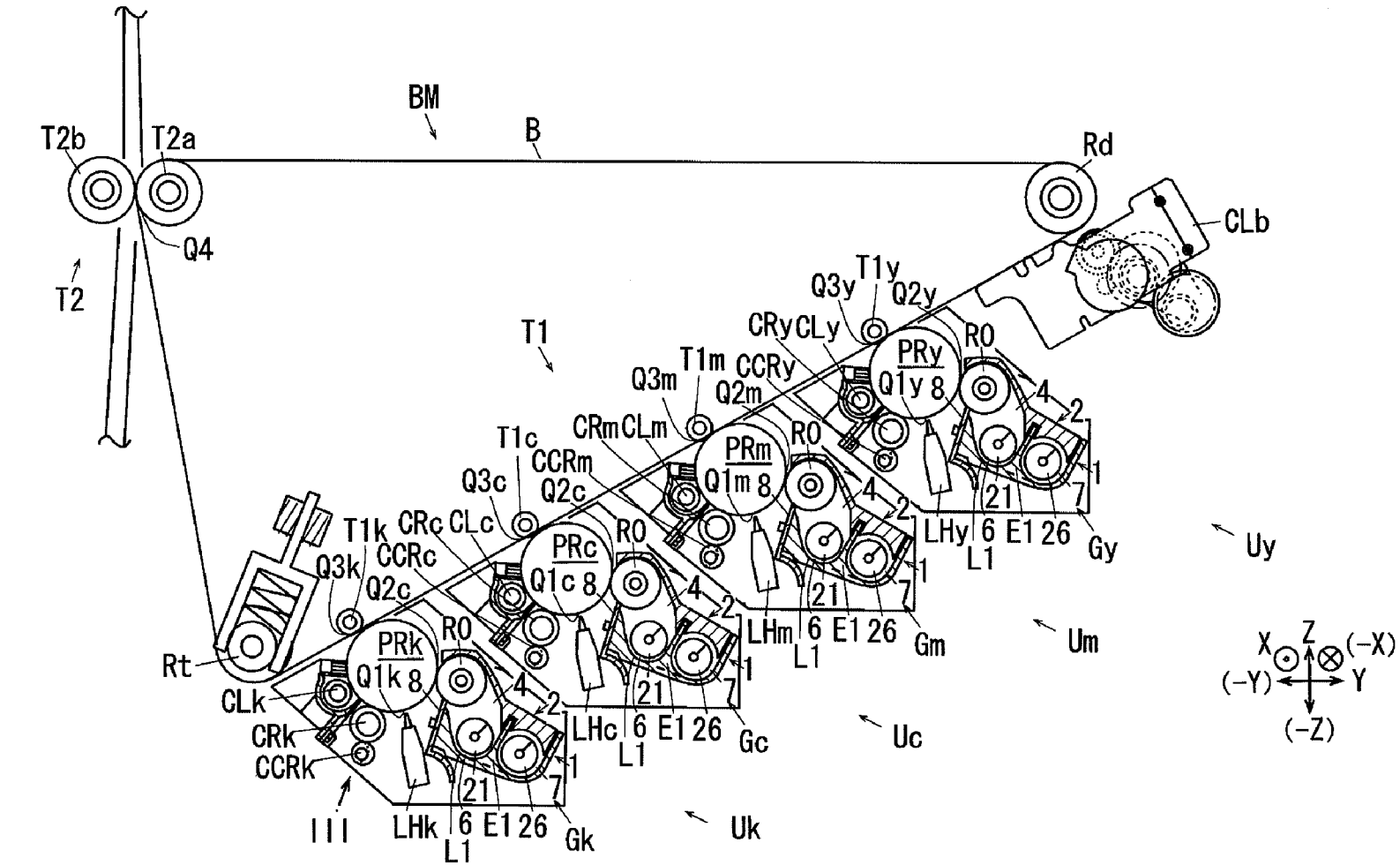
FIG. 2 is an enlarged view of the developing device and a transfer device according to Example 1 of the invention.

FIG. 2 is an enlarged view of the developing device and a transfer device according to Example 1 of the invention.

In FIG. 1, a digital copier U as an example of the image forming apparatus is equipped with, in order from an upper portion: an image scanner U1 as an example of an image reader that includes an automatic original conveyance device U1*a* and an image reader body U1*b* having a platen glass PG as an example of a transparent platen; and a printer U2 as an example of an image recording device.

The automatic original conveyance device U1*a* has a paper feeding tray TG1 as an example of a paper receiving section that receives plural originals Gi to be copied with the originals Gi being stacked. Each of the plural originals Gi placed on the paper feeding tray TG1 sequentially passes through a paper reading position PS located on the platen glass PG and are discharged to the paper receiving tray TG2 as an example of a paper discharge section.

The image reader body U1*b* of the image scanner U1 includes: a operation section UI through which a user inputs command signals for starting a copying process; an exposure optical system A; an image processing section GS; and the like.

A CCD (solid state imaging device) converts reflection light, which is reflected from an original (not shown in the drawing) manually placed on the platen glass PG or the original Gi conveyed from the image scanner U1 to the platen glass PG, into electric signals of R (red), G (green), and B (blue), via the exposure optical system A.

The image processing section GS converts the electric signals of RGB input by the CCD into image data of Y (yellow), M (magenta), C (cyan), and K (black), temporally stores the image data, and outputs the image data to a circuit DL for driving latent image writing device of the printer U2 as image data for forming a latent image, at a predetermined timing.

In addition, when the original image is monochrome, the image processing section GS outputs image data of only K (black) to the circuit DL for driving the latent image writing device.

The circuit DL for driving the latent image writing device has separate driving circuits (not shown in the drawing) for the respective colors of Y, M, C, and K, and outputs a driving signal based on the image data, which is input from the image processing section GS, to LED heads LHy, LHm, LHc, and LHk as an example of an electrostatic latent image writing device, at a predetermined timing.

In a right side of the LED heads LHy, LHm, LHc, and LHk, developing devices Gy, Gm, Gc, and Gk are supported (will be described in detail later), respectively. Photoreceptors PRy, PRm, PRc, and PRk as an example of an image carrier are disposed so as to correspond to the developing devices Gy, Gm, Gc, and Gk, respectively. After the plural photoreceptors PRy, PRm, PRc, and PRk are charged by charging rollers CRy, CRm, CRc, and CRk as an example of a charger, respectively, electrostatic latent images are formed in image forming positions Q1*y*, Q1*m*, Q1*c*, and Q1*k* on surfaces of the photoreceptors by light beams for latent images of Y, M, C, and K, which are emitted from the LED heads Lhy to LHk. The electrostatic latent images on the surfaces of the photoreceptors PRy, PRm, PRc, and PRk are developed into toner images as an example of visible images by the developing devices Gy, Gm, Gc, and Gk in developing areas Q2*y*, Q2*m*, Q2*c*, and Q2*k*.

The developed toner images are conveyed to primary transfer areas Q3*y*, Q3*m*, Q3*c*, and Q3*k* that contact with an intermediate transfer belt B as an example of an intermediate transfer body. In the primary transfer areas Q3*y*, Q3*m*, Q3*c*, and Q3*k*, a first transfer voltage having a polarity opposite to a charged polarity of the toner is applied at a predetermined timing from a power circuit E (see FIG. 1), which is controlled by a control section C, to first transfer rollers T1*y*, T1*m*, T1*c*, and T1*k* as an example of a primary transfer device, which are disposed on a rear side of the intermediate transfer belt B. T1*y*, T1*m*, T1*c*, and T1*k* constitute a primary transfer device T1.

The toner images on the photoreceptors PRy to PRk are firstly transferred to the intermediate transfer belt B by the first transfer rollers T1*y*, T1*m*, T1*c*, and T1. Toner remaining on the surfaces of the photoreceptors PRy, PRm, PRc, and PRk after primary transfer is removed by photoreceptor cleaners CLy, CLm, CLc, and CLk as an example of an image carrier cleaner. Also, the toner remaining on the surfaces of the charging rollers CRy, CRm, CRc, and CRk is removed by charging roller cleaners CCRy, CCRm, CCRc, and CCRk as an example of a charge cleaner.

Toner image forming devices Uy, Um, Uc, and Uk as an example of an image carrier unit for forming a toner image includes: the photoreceptors PRy, PRm, PRc, and PRk; the charging rollers CRy, CRm, CRc, and CRk; the LED heads LHy, LHm, LHc, and LHk; the developing devices Gy, Gm, Gc, and Gk; and the photoreceptor cleaners CLy, CLm, CLc, and CLk, which correspond to the respective colors of Y, M, C, and K. Also, the toner image forming devices Uy, Um, Uc, and Uk are formed into units for the respective colors and are formed as an exchangeable image carrier unit detachable from the image forming apparatus U, that is, a process cartridge.

A belt module BM as an example of an intermediate transfer unit is disposed on the upper side of the photoreceptors PRy to PRk. The belt module BM includes: the intermediate transfer belt B; a belt supporting roller (Rt, Rd, and T2*a*) as an example of an intermediate transfer body holder having a tension roller Rt as an example of a tension generating member, a driving roller Rd as an example of a driving member, and a back-up roller T2*a* as an example of a secondary transfer opposing member; the primary transfer rollers T1*y*, T1*m*, T1*c*, and T1*k*; a belt cleaner CLb as an example of an intermediate transfer body cleaner; and a frame body (not shown in the drawing) for supporting them. The intermediate transfer belt B is rotatably supported by the belt supporting roller (Rt, Rd, and T2*a*).

In FIGS. 1 and 2, a secondary transfer roller T2*b* as an example of a secondary transfer member is disposed so as to face the surface of the intermediate transfer belt B contacting with the back-up roller T2*a*. A secondary transfer area Q4 is formed on an area where the intermediate transfer belt B faces the secondary transfer roller T2*b*. The secondary transfer roller T2*b* is supported by the frame of the printer U2.

In Example 1, the back-up roller T2*a* is grounded, the secondary transfer voltage that has a polarity opposite to the charged polarity of the toner is applied from the power circuit E (see FIG. 1) controlled by the control section C to the secondary transfer roller T2*b* at the predetermined timing.

A secondary transfer device T2 includes the rollers T2*a* and T2*b*. The primary transfer device T1, the intermediate transfer belt B, and the secondary transfer device T2 constitute a transfer device (T1+B+T2), which transfers the toner images on the surfaces of the photoreceptors PRy, PRm, PRc, and PRk into a recording sheet S as an example of a medium.

In the primary transfer areas Q3*y*, Q3*m*, Q3*c*, and Q3*k*, multi-color toner images or monochromatic toner images, which are transferred so as to be sequentially overlapped with the intermediate transfer belt B by the transfer devices T1*y*, T1*m*, T1*c*, and T1*k*, are conveyed to the secondary transfer area Q4.

In a lower side of the process cartridges Uy, Um, Uc, and Uk, plural paper feeding containers, that is, the so-called paper feeding trays TR1 to TR4 are detachably supported by a pair of guide members, that is, so-called guide rails GR and GR. The recording sheets S as an example of media in the paper feeding trays TR1 to TR4 are taken out by the pick-up roller Rp as an example of an ejecting member and are separated one by one by a separating roller Rs as an example of a separating member. The recording sheets S separated one by one are conveyed by conveyance rollers Ra as an example of plural conveyance members and are sent to registration rollers Rr as an example of a member for controlling a transfer position and a timing of conveyance. The registration rollers Rr convey the recording sheets S to the secondary transfer area Q4 in accordance with a timing when the toner image, which is primarily transferred to the intermediate transfer belt B, is conveyed to the secondary transfer area Q4.

The toner image on the intermediate transfer belt B is transferred to the recording sheet S by the secondary transfer device T2 while passing through the secondary transfer area Q4. The intermediate transfer belt B after the second transfer is cleaned by the belt cleaner CLb.

The recording sheet S in which the toner image is secondarily transferred is conveyed to a fixation area Q5. A fixing device F includes a heating roller Fh as an example of a heat-fixing member and a pressure roller Fp as an example of a pressure-fixing member. The recording sheet S, which is conveyed to the fixation area Q5 formed in a pressed portion between the heating roller Fh and the pressure roller Fp, has the toner image fixed thereon by heat while passing through the fixation area Q5. Then, the recording sheet S is discharged from discharging rollers Rh to a receiving tray TRh. The elements represented by the reference signs Rp, Rs, Ra, Rr, Rh, and the like constitute a sheet conveyance device SH as an example of a medium conveyance device.

In addition, on the surface of the heating roller Fh, a release agent for easily releasing the recording sheet S from the heating roller Fh is coated by a release-agent coating device Fa.

Developer cassettes Ky, Km, Kc, and Kk as an example of a developer replenishing container, which contain developers of Y(yellow), M(magenta), C(cyan), and K(black), respectively, are disposed on the upper side of the belt module BM. The developers contained in the developer cassettes Ky, Km, Kc, and Kk are replenished through developer replenishing paths that are not shown in the drawings to the developing devices Gy, Gm, Gc, and Gk, in accordance with consumption of the developers in the developing devices Gy, Gm, Gc, and Gk.

(Description of Developing Device)

Figure 3:
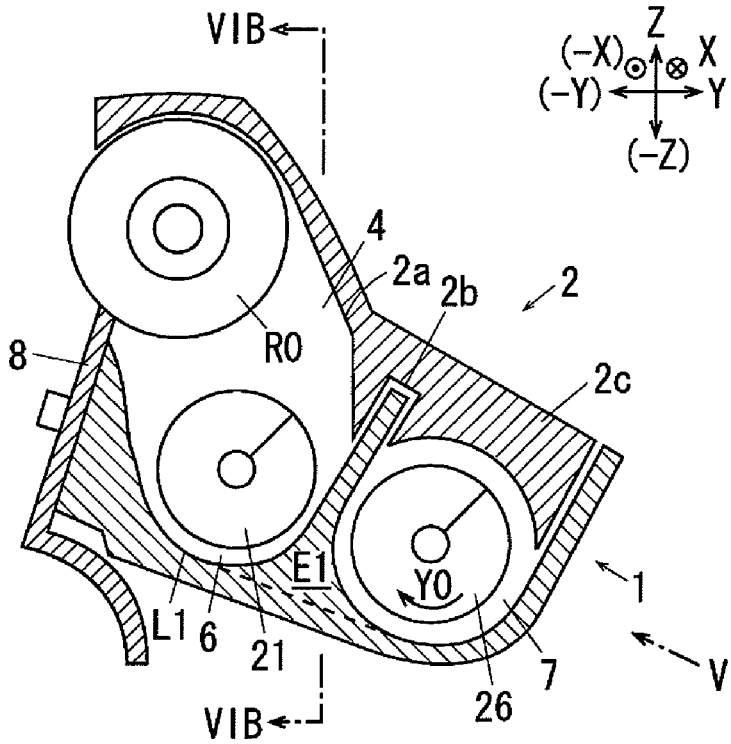
FIG. 3 is a section view of a center portion of the developing device according to Example 1 of the invention taken along a front and rear direction.

FIG. 3 is a section view of a center portion of the developing device according to Example 1 of the invention taken along the front and rear direction.

Figure 4A:
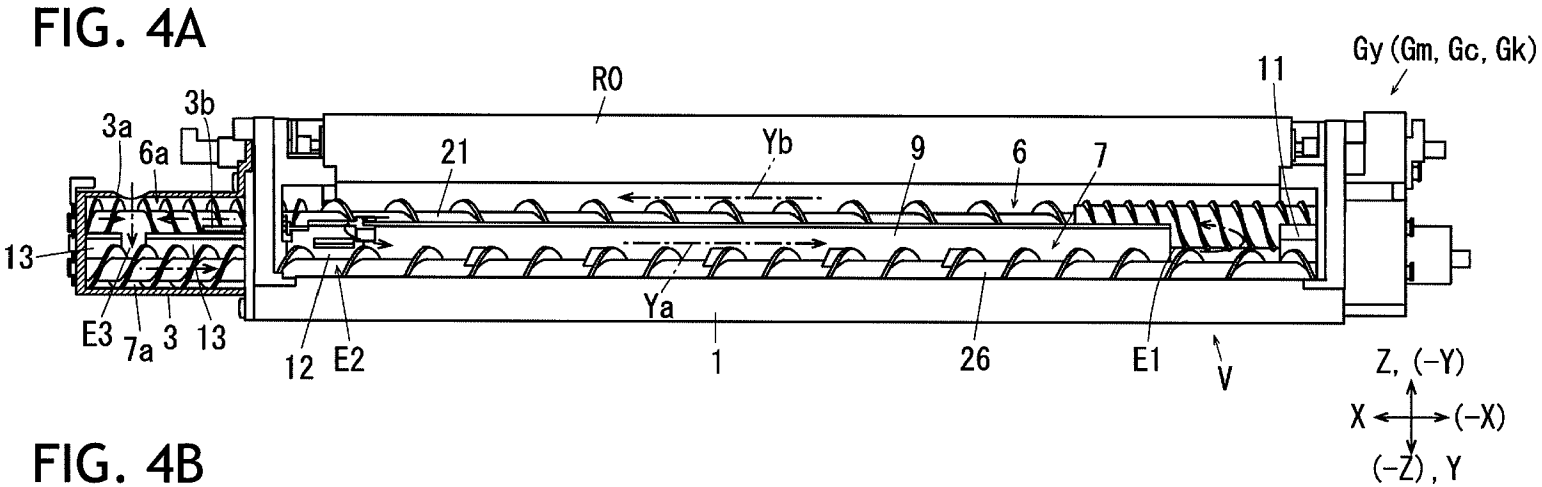
FIG. 4A is a sectional perspective view illustrating the main portion in a state where a developer container cover is removed.
Figure 4B:
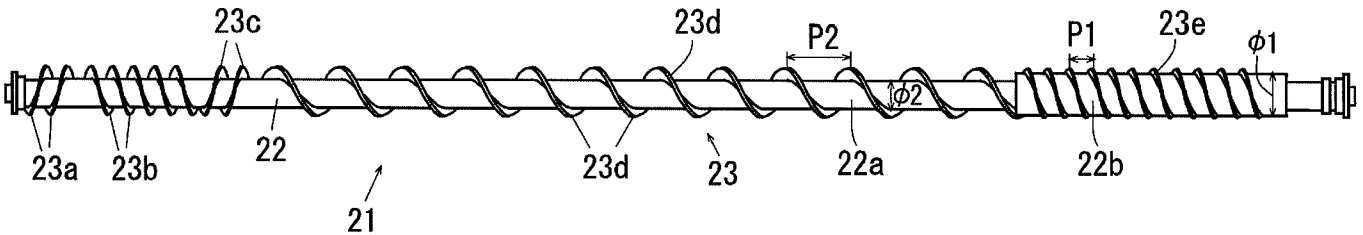
FIG. 4B is an enlarged view illustrating a feeding auger according to Example 1.
Figure 4C:
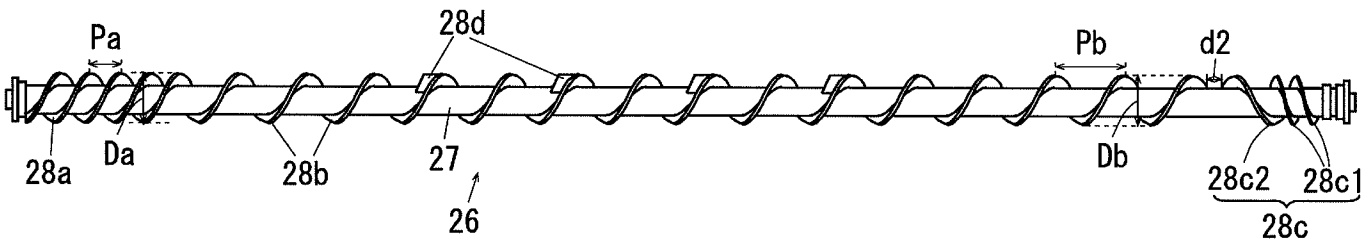
FIG. 4C is an enlarged view illustrating a stirring auger according to Example 1.

FIG. 4 is an explanatory diagram illustrating the entire configuration of the developing device according to Example 1 of the invention, FIG. 4A is a sectional perspective view illustrating the main portion in the state where a developer container cover is removed, FIG. 4B is an enlarged view illustrating a feeding auger according to Example 1, and FIG. 4C is an enlarged view illustrating a stirring auger according to Example 1.

Figure 5:
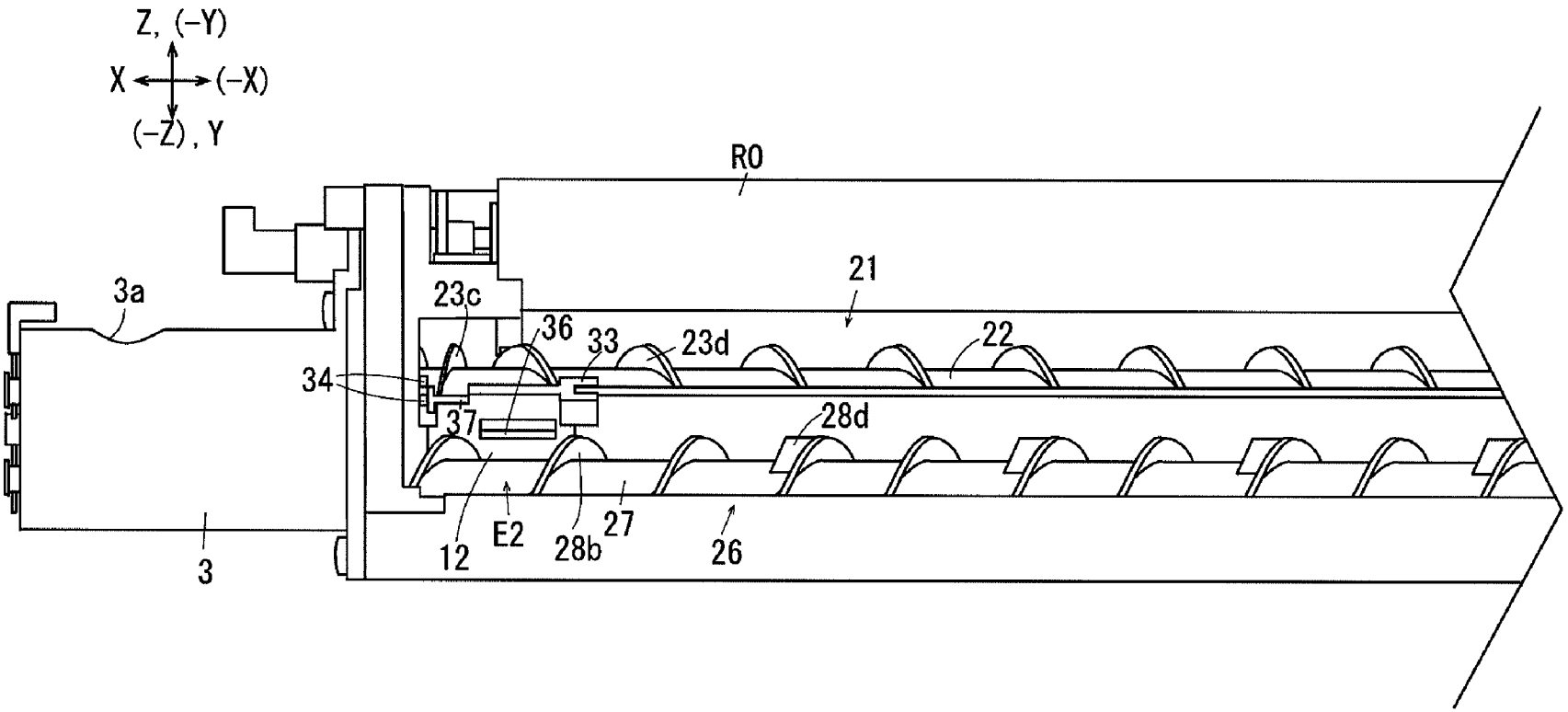
FIG. 5 is an enlarged view illustrating a front end portion of the developing device shown in FIG. 4.

FIG. 5 is an enlarged view illustrating a front end portion of the developing device shown in FIG. 4.

Figure 6A:
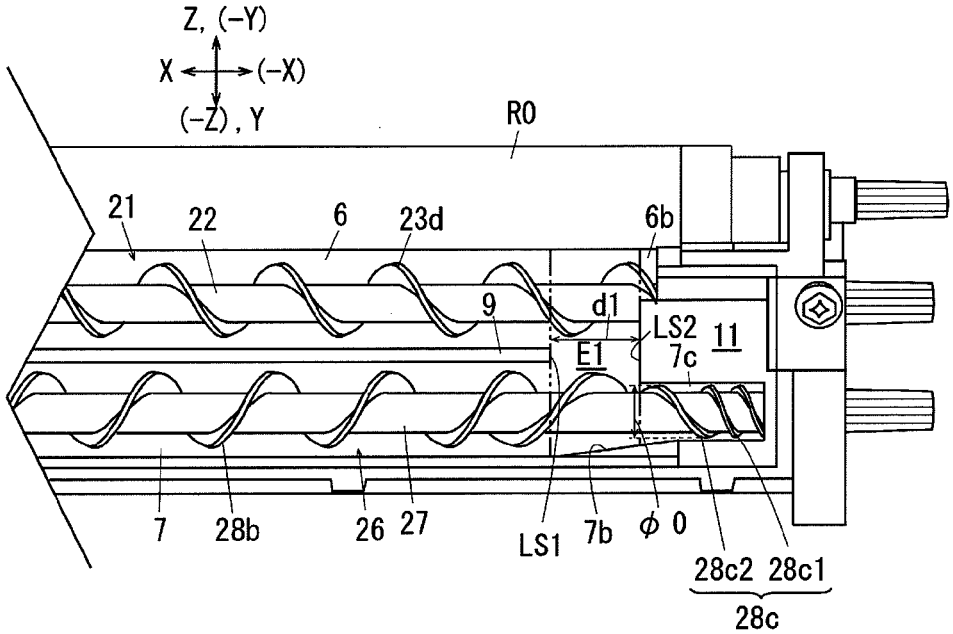
FIG. 6A is a perspective explanatory diagram illustrating the main portion of the rear end portion of the developing device.
Figure 6B:
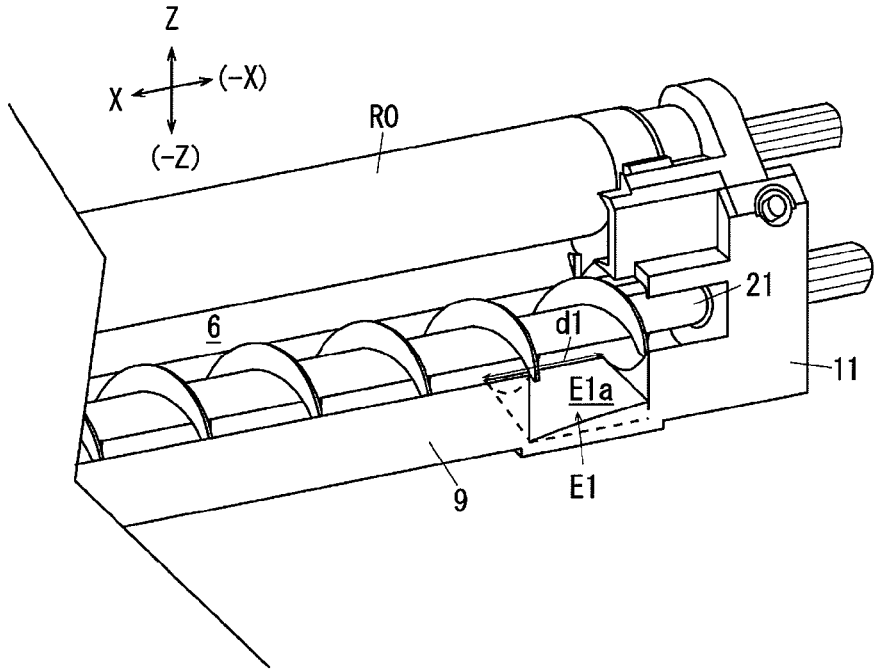
FIG. 6B is a sectional perspective view taken along the line VIB-VIB shown in FIG. 3.

FIG. 6 is an enlarged view illustrating a rear end portion of the developing device, FIG. 6A is a perspective explanatory diagram illustrating the main portion of the rear end portion of the developing device, and FIG. 6B is a sectional perspective view taken along the line VIB-VIB shown in FIG. 3.

Next, the developing devices Gy, Gm, Gc, and Gk according to Example 1 of the invention will be described. Since the developing devices Gy, Gm, Gc, and Gk of the respective colors have the same configuration, only the developing device Gy of Y color will be described in detail, and detailed description of the developing devices Gm, Gc, and Gk of the other colors will be omitted.

In FIGS. 2 to 5, the developing device Gy, which is disposed to face the photoreceptor Pry, has a developer container V containing two-component developer including toner and carrier. The developer container V includes: a developer container body 1; the developer container cover 2 as an example of a cover member for covering an upper end of the developer container body 1 as shown in FIGS. 2 and 3; and a developer supply/disposal vessel 3 as an example of a developer supply/disposal member connected to a front end of the developer container body 1 as shown in FIG. 5.

The developer container cover 2 has a supply-side block section 2*a* having a reversed L shape, a partition wall engagement section 2*b* having a reversed concave shape, and a second stirring chamber top wall edge section 2*c* having a half cylindrical shape.

In FIGS. 2 to 4, the developer container body 1 includes, in an inner side of the developer container body 1: a developing roller chamber 4, a first stirring chamber 6 as an example of a first developer containing chamber adjacent to the developing roller chamber 4; and a second stirring chamber 7 as an example of a second developer containing chamber that is disposed obliquely adjacent to the lower right side of the first stirring chamber 6 in order to decrease a size of the developer container V in the horizontal direction and the vertical direction. A developing roller R0 as an example of a developer carrier is contained in the developing roller chamber 4. A thickness regulating member 8 for regulating a layer thickness of developer on a surface of the developing roller R0 is disposed on an upstream side of the developing roller R0 in its rotation direction.

In FIGS. 4 and 5, a supply/disposal chamber 6*a* inside the developer supply/disposal vessel 3 is connected to a front side of the first stirring chamber 6. A replenishing chamber 7*a* inside the developer supply/disposal vessel 3 is connected to a front side of the second stirring chamber 7. In FIG. 4, a developer replenishing port 3*a* that replenishes developer from the developer cassettes Ky, Km, Kc, and Kk is formed on an upper face of the front end portion (an end portion in the +X direction) of the supply/disposal chamber 6*a*. Also, a developer outlet 3*b* as an example of a developer discharge section is formed on a lower face of a rear portion of the supply/disposal chamber 6*a*. The wasted developer discharged and dropped from the developer outlet 3*b* is collected in a developer collecting container that is not shown in the drawings.

As shown in FIGS. 3 to 6, in the developer container body 1, a partition wall 9 that has a convex shape engaging with the partitioning-wall engagement section 2*b* is formed on a portion between the first stirring chamber 6 and the second stirring chamber 7, excluding both end portions of them. A rear end partition wall 11 is formed on a rear end portion thereof. Accordingly, the first stirring chamber 6 and the second stirring chamber 7 communicate with each other through an upward inflow section E1 as an example of a first inflow section disposed between the partition wall 9 and the rear end partition wall 11 and through a downward inflow section E2 as an example of a second inflow section disposed on a front side of the body 1. Thereby, the developer container body 1 is configured to be able to circulate developer.

In the lower face of the second stirring chamber 7 according to Example 1, an inclined surface 7*b* is disposed in a position corresponding to the upward inflow section E1. A diameter of the semicylindrical lower face of the second stirring chamber 7 decreases as it moves from the front side of the upward inflow section E1 to the rear side thereof. Accordingly, the bottom of the second stirring chamber 7 becomes higher as it moves in the rear direction (−X direction). Also, in the second stirring chamber 7, a backward-direction conveyor blade containing chamber 7*c* that contains a backward-direction conveyor blade (28*c*) of a stirring auger (26) is formed in a position corresponding to the rear end partition wall 11. A diameter of the backward-direction conveyor blade containing chamber 7*c* is smaller than the diameter of the lower face of the second stirring chamber 7 in a position corresponding to the partition wall 9, by a dimension corresponding to the inclined surface 7*b*.

In the upward inflow section E1, the lower face of the first stirring chamber 6 is connected to the lower face of the second stirring chamber 7 through an inflow incline E1*a* that inclines toward the first stirring chamber 6 located on the upper side thereof. That is, the inflow incline E1*a* is formed in a planar shape extending along a common tangent line that connects the bottom face of the first stirring chamber 6 and the bottom face of the second stirring chamber 7. Accordingly, in the front end of the upward inflow section E1 as shown in FIG. 6A, the inflow incline E1*a* is formed along a common tangent line LS1, which is represented by a dashed line in FIG. 3 and which connects the lower faces of the first stirring chamber 6 and the second stirring chamber 7. In the rear end of the upward inflow section E1, the inflow incline E1*a* is formed along a common tangent line LS2 connecting the rear ends of the first stirring chamber 6 and the inclined surface 7*b*.

In Example 1, a width from the front end of the upward inflow section E1 to the rear end of the upward inflow section E1, that is, an inflow width d1 is set to 28 mm.

As shown in FIGS. 4A, 6A, and 6B, the upward inflow section E1 according to Example 1 is disposed in a position where the upward inflow section E1 overlaps with the rear end portion of the developing roller R0. That is, the upward inflow section E1 is disposed in a position where the upward inflow section E1 overlaps with a range (image forming region) in which the development is performed.

Also, an opening forming member 12 is mounted on the downward inflow section E2. The opening forming member 12 will be detailed later. In the developer supply/disposal vessel 3, a partition wall 13 is formed between the supply/disposal chamber 6*a* and the replenishing chamber 7*a*. Accordingly, as shown in FIG. 4, the supply/disposal chamber 6*a* and the replenishing chamber 7*a* are connected to each other through a replenishing inflow section E3 serving as an example of the third inflow section. With this configuration, developer can flow from the supply/disposal chamber 6*a* into the replenishing chamber 7*a*.

A circulation stirring chamber (6+7) includes the first stirring chamber 6 and the second stirring chamber 7.

In FIGS. 3 to 6, in the first stirring chamber 6, a feeding auger 21 as an example of a first conveyance member that conveys and supplies developer to the developing roller R0 while stirring the developer. The feeding auger 21 has a first rotation shaft 22 extending in parallel with the axial direction of the developing roller R0 and a helical first conveyor blade 23 supported by the outer circumference of the first rotation shaft 22.

In FIG. 4B, the first rotation shaft 22 of the first conveyance member 21 according to Example 1 has a large diameter shaft portion 22*b*, which has a diameter ϕ1 and which is disposed in a position corresponding to the upward inflow section E1, and a small diameter shaft portion 22*a* having a diameter ϕ2 smaller than the diameter ϕ1.

Also, the first conveyor blade 23 includes: a replenishing backward-direction conveyor blade 23*a* disposed so as to correspond to the front end portion of the supply/disposal chamber 6*a*; an disposal conveyor blade 23*b* as an example of a fourth conveyance member disposed so as to correspond to a range from the center portion of the supply/disposal chamber 6*a* to the rear portion of the supply/disposal chamber 6*a*; a circulating backward-direction conveyor blade 23*c* as an example of a third conveyance member disposed so as to correspond to a range from the rear end portion of the supply/disposal chamber 6*a* to the front side of the downward inflow section E2; a first main stirring conveyor blade 23*d* disposed so as to correspond to the small diameter shaft portion 22*a* between the downward inflow section E2 and the front end of the upward inflow section E1; and a speed-reduction conveyor blade 23*e* disposed so as to correspond to the large diameter shaft portion 22*b*.

In Example 1, the respective blades 23*a* to 23*e* are formed in a helical shape. In this case, a pitch P2 is set larger than a pitch P1 of the conveyor blades 23*a* to 23*c* and the speed-reduction conveyor blade 23*e*. The pitch P2 is defined as a distance by which developer moves during a single rotation of the first main stirring conveyor blade 23*d*, that is, a distance between blades adjacent to each other in the axial direction. In Example 1, the feeding auger 21 is configured so that the first rotation shaft 22 and the first conveyor blade 23 are integrally formed of resin. However, the shaft the conveyor blades may be provided separately and may be assembled. In Example 1, the blades 23*a* to 23*e* are disposed on the one first rotation shaft 22, but not limited to this configuration. For example, the blades and shafts may be provided separately so that the replenishing backward-direction conveyor blade 23*a* and its rotation shaft, the disposal conveyor blade 23*b* and its rotation shaft, the circulating backward-direction conveyor blade 23*c* and its rotation shaft, the first main stirring conveyor blade 23*d* and its rotation shaft, and the speed-reduction conveyor blade 23*e* and its rotation shaft thereof.

In the second stirring chamber 7, a stirring auger 26 as an example of a second conveyance member that conveys developer while stirring the developer. The stirring auger 26 has a second rotation shaft 27 extending in parallel with the axial direction of the developing roller R0 and a helical second conveyor blade 28 supported by the outer circumference of the second rotation shaft 27. The second conveyor blade 28 includes: a replenishing conveyor blade 28*a* disposed so as to correspond to the replenishing chamber 7*a*; a second main stirring conveyor blade 28*b* as an example of a forward-direction conveyor blade disposed so as to correspond to a range from the downward inflow section E2 to the rear side of the upward inflow section E1; and a backward-direction conveyor blade 28*c* as an example of the backward-direction conveyor blade disposed so as to correspond to the backward-direction conveyor blade containing chamber 7*c*.

In Example 1, the blades 28*a* to 28*c* are formed in a helical shape. Also, a pitch of the second main stirring conveyor blade 28*b* is set larger than pitches of the conveyor blades 23*a* to 23*c*. In addition, the pitch of the second main stirring conveyor blade 28*b* is set, in advance, smaller than the inflow width d1 (28 mm) of the upward inflow section E1. Specifically, the pitch of the second main stirring conveyor blade 28*b* is set to 22 mm. Also, in the rear end portion of the second main stirring conveyor blade 28*b*, a helix diameter that is an outside diameter of the second main stirring conveyor blade 28*b* continuously decreases in accordance with an inclined surface 7*b* of the second stirring chamber 7.

Also, the backward-direction conveyor blade 28*c* includes: a first backward-direction conveyor blade 28*c*1 as an example of a downstream side backward-direction conveyor blade, which is disposed from the rear end portion of the second stirring chamber 7, which has 5 mm in pitch and which has two in number of turns; and a second backward-direction conveyor blade 28*c*2 as an example of an upstream side backward-direction conveyor blade, which has 14 mm in pitch and ½ in number of turns. The first backward-direction conveyor blade 28*c*1 and the second backward-direction conveyor blade 28*c*2 are formed continuously.

In Example 1, a distance d2 between the downstream end of the second main stirring conveyor blade 28*b* and the upstream end of the second backward-direction conveyor blade 28*c*2 of the backward-direction conveyor blade 28*c* is set to 8 mm. In addition, a helix diameter ϕ0 of the backward-direction conveyor blade 28*c* is set to 14 mm that is the same length as the pitch of the second backward-direction conveyor blade 28*c*2.

As shown in FIG. 4, plural stirring members 28*d* having a planar shape are disposed at predetermined intervals in a region where the second main conveyor blade 28*b* is disposed and are supported by the second rotation shaft 28. Also, the stirring auger 26 of Example 1 is integrally formed in the same manner as the feeding auger 21. In Example 1, the blades 28*a* to 28*c* are disposed on the one second rotation shaft 27, but not limited to this. For example, the blades and shafts may be provided separately so that the replenishing conveyor blade 28*a* and its rotation shaft, the second main stirring conveyor blade 28*b* and its rotation shaft thereof, and the backward-direction conveyor blade 28*c* and its rotation shaft thereof.

In Example 1, rotational power of a motor, which is not shown in the drawings, used in the developing device is transmitted to a gear, and the motor rotates the stirring auger 26 in a rotational direction Y0 shown in FIG. 3. In this case, in the stirring auger 26, a winding direction and a rotational direction of the second conveyor blade 28 are set so that developer is biased toward the left side in the second stirring chamber 7 in response to the rotational direction Y0, that is, the developer receives a force in such a direction that the developer is raised to the first stirring chamber 6 side in the upward inflow section E1 (see FIG. 4C).

When the conveyance members 21 and 26 rotate, the replenishing backward-direction conveyor blade 23*a* and the disposal conveyor blade 23*b* flows into the replenishing inflow section E3 the developer replenished from the developer replenishing port 3*a* and conveys the developer to the replenishing chamber 7*a*. The developer conveyed to the replenishing chamber 7*a* is conveyed to the second stirring chamber 7 in the developer container body 1 by the replenishing conveyor blade 28*a*. Then, the developer is conveyed to the second developer conveyance direction Ya by the second main conveyor blade 28*b*. The developer conveyed to the upward inflow section E1 is stayed there by the second main conveyor blade 28*b* and the backward-direction conveyor blade 28*c* that conveys the developer in a direction opposite to the second developer conveyance direction Ya. Thereby, an amount of the staying developer increases, and the developer flows into the first stirring chamber 6 in an obliquely upward direction.

The developer flowing into the first stirring chamber 6 is conveyed by the first main conveyor blade 23*d* in a first developer conveyance direction Yb opposite to the second developer conveyance direction Ya. The developer conveyed to the first stirring chamber 6 is adhered to the surface of the developing roller R0 by magnetic force during the conveying process, and is used in the developing process. The developer conveyed to the downward inflow section E2 is stayed in the downward inflow section E2 by the circulating backward-direction conveyor blade 23*c* that conveys the developer in a direction opposite to the first developer conveyance direction Yb. Then, the developer flows into the second stirring chamber 7 through the downward inflow section E2 due to gravity. As a result, developer is circulated and conveyed while the developer in the stirring chambers 6 and 7 is stirred by the stirring members 21 and 26.

Also, when the amount of the developer in the downward inflow section E2 increases, a part of the developer can not be conveyed by the circulating backward-direction conveyor blade 23*c* in the backward direction. Thus, the residual developer flows even into the disposal conveyor blade 23*b* in the supply/disposal chamber 7*a*. In this case, the developer flowing over the circulating backward-direction conveyor blade 23*c* into the disposal conveyor blade 23*b* side is conveyed to the developer outlet 3*b* and is exhausted therethrough, by the disposal conveyor blade 23*b*.

(Description of Opening Forming Member)

Figure 7:
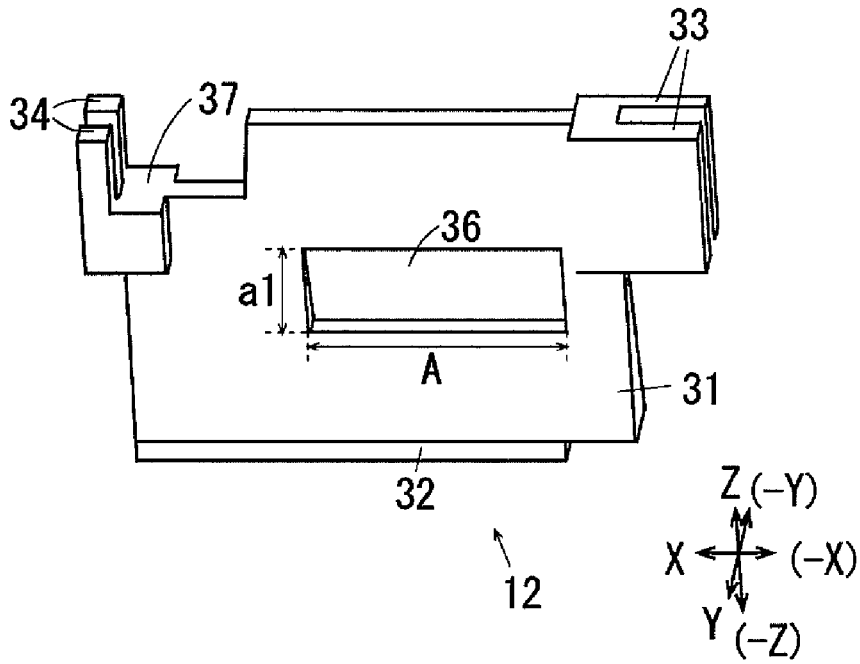
FIG. 7 is an explanatory diagram illustrating an opening forming member of the developing device according to Example 1.

FIG. 7 is an explanatory diagram illustrating the opening forming member 12 of the developing device according to Example 1.

In FIGS. 3 to 7, the opening forming member 12 disposed in the downward inflow section E2 has a forming member body 31 formed so as to correspond to the partition wall 9. On the forming member body 31, a supported portion 32 is formed so as to have a shape in conformity with the bottom face of the downward inflow section E2. The forming member body 31 is supported through the supported portion 32 by the bottom face of the downward inflow section E2. On the upper rear end of the forming member body 31, a partition wall sandwiching portion 33 is formed in a bifurcated shape. The partition wall sandwiching portion 33 is positioned and fixed with the partition wall 9 being interposed therebetween when the partition wall sandwiching portion 33 is mounted on the downward inflow section E2. Also, a wall engagement section 34 engaging the front wall of the developer container body 1 is formed on the upper front end of the forming member body 31. In FIGS. 5 and 7, in right side of the center portion of the forming member body 31 in the up and down direction, that is, on the upstream side in the first developer conveyance direction Yb, there is formed a first opening portion 36 having a size of horizontal width A×vertical length a1 and penetrating therethrough in the right and left direction. In addition, in Example 1, the size of the first opening portion 36 is set to 12 mm×4.5 mm.

In the forming member body 31, there is formed a second opening portion 37 penetrating through the rear upper end portion of the wall engagement section 34 in the right and left direction. Accordingly, the second opening portion 37 is disposed on the downstream side in the first developer conveyance direction Yb and the upper side in the perpendicular direction with respect to the position of the first opening portion 36. In addition, in Example 1, the size of the second opening portion 37 is set so as to have width 6 mm×length 3 mm, that is, have an opening area smaller than that of the first opening portion 36.

In FIG. 5, in the opening forming member 12 of Example 1, the first opening portion 36 is disposed in a position where the first opening portion 36 overlaps with a part of the front end portion of the developing roller R0, that is, in a position where a part of the first opening portion 36 in the axial direction overlaps with a range where the developing process is performed, in order to decrease an axial length of the developing roller of the developer container V so as to be as short as possible. The second opening portion 37 is disposed in a position out of a range where the developing process is performed in order to prevent occurrence of overflow of developer or shortage of developer in the end portion of the range where the developing process is performed and prevent occurrence of unevenness in density at the time of image formation that is caused by the overflow or shortage of developer. The second opening portion 37 is also disposed so as to correspond to the position of the circulating backward-direction conveyor blade 23*c* in order to only flow the overflowing developer into the second stirring chamber 7.

(Effect of Example 1)

In the image forming apparatus U having the configuration of Example 1, the developer conveyed to the second stirring chamber 7 in the second developer conveyance direction Ya is conveyed to the upward inflow section E1 by the second main conveyor blade 28*b* of the stirring auger 26. The developer conveyed to the upward inflow section E1 is conveyed in the backward direction by the backward-direction conveyor blade 28*c*. Thus, it is possible to stay and block the developer in the rear end of the upward inflow section E1. As a result, the developer amount in the upward inflow section E1 increases, and the developer flows into the first stirring chamber 6 in the obliquely upward direction through the inflow incline E1*a*. In this case, in the upward inflow section E1, the first stirring chamber 6 is connected to the second stirring chamber 7 through the inflow incline E1*a*. The inflow incline E1*a* is formed in a planar shape, and extends along the common tangent line which connects the bottom face of the first stirring chamber 6 to the bottom face of the second stirring chamber 7. Accordingly, as compared with the case where a step formed in the connection portion becomes an obstacle, for example, like the case where the semicylindrical bottom faces of the second stirring chamber 7 and the first stirring chamber 6 are connected to each other, the upward inflow section E1 of the image forming apparatus U according to Example 1 can reduce an obstacle when the developer flows into the first stirring chamber 6. Therefore, it is possible to easily flow the developer into the first stirring chamber 6.

Also, the image forming apparatus U according to Example 1, the inclined surface 7*b* of the second stirring chamber 7 increases the bottom level of the second stirring chamber 7 as it goes in the rear direction (−X direction). That is, the conveyed developer is raised up by the inclined surface 7*b* inclining in the obliquely upward direction as it goes from the front end of the upward inflow section E1 to the rear end thereof. Accordingly, as compared with the case where the inclined surface 7*b* is not provided, the image forming apparatus U according to Example 1 is configured so that the developer blocked in the upward inflow section E1 can easily flow into the first stirring chamber 6 in the obliquely upward direction.

Also, in the image forming apparatus U according to Example 1, the upper side of the second stirring chamber 7 is covered by the second stirring chamber wall edge section 2*c* having the semicylindrical shape (see FIG. 3). The second stirring chamber 7 is formed as a space having a circular shape in section to surround the circumference of the stirring auger 26 in a range other than the upward inflow section E1, that is, in a range corresponding to the partition walls 9 and 11. Accordingly, as compared with the case where the second stirring chamber 7 is formed in a U shape in section, it is possible to reduce the excess gap in the upper side of the stirring auger 26. Thus, it is possible to suppress, from backward flowing in the second developer conveyance direction Ya, the developer whose height is increased by the blocking in the upward inflow section E1. As a result, the image forming apparatus U according to Example 1 can convey developer to the first stirring chamber 6 by efficiently blocking the developer in the upward inflow section E1, and can ensure conveyability of the stirring auger 26 by suppressing developer from backward flowing.

In addition, in the image forming apparatus U according to the Example 1, the stirring auger 26 receives, due to the winding direction and rotational direction of the second conveyor blade 28, the force in such a direction that the developer blocked by the upward inflow section E1 is raised up to the first stirring chamber 6. Thus, the stirring auger 26 is easy to flow the developer into the first stirring chamber 6.

Also, in the backward-direction conveyor blade 28*c* of the second conveyor blade 28, the second backward-direction conveyor blade 28*c*2 disposed on the downstream side in the conveyance direction (which is opposite to the second developer conveyance direction Ya) of the backward-direction conveyor blade 28*c* is set so as to have a larger pitch than the first backward-direction conveyor blade 28*c*1 disposed on the upstream side thereof. Accordingly, as compared with the first backward-direction conveyor blade 28*c*1 disposed on the upstream side, the second backward-direction conveyor blade 28*c*2 can increase the force (blocking force) that pushes back the developer to the downstream end in the conveyance direction (which is opposite to the second developer conveyance direction Ya) of the backward-direction conveyor blade 28*c*, that is, to the rear end of the upward inflow section E1.

In the image forming apparatus U according to Example 1, the upward inflow section E1 is disposed in the position where the upward inflow section E1 overlaps with the rear end portion of the developing roller R0, that is, in a position which is in the range where the developing process is performed. Thus, it is possible to decrease the axial length of the developing roller R0 of the developer container V (see FIGS. 4A, 6A, and 6B). Also, in the feeding auger 21, the conveyable area of the speed-reduction conveyor blade 23*e* in section becomes small because of the large diameter shaft portion 22*b*, which has the diameter (ϕ1 and which is disposed in the range corresponding to the upward inflow section E1. Thus, developer conveyance speed in the range corresponding to the upward inflow section E1, that is, developer conveyance speed of the large diameter shaft portion 22*a* is slower than that of the small diameter shaft portion 22*a* on the downstream side. In addition, the pitch P1 of the speed-reduction conveyor blade 23*e* disposed on the large diameter shaft portion 22*b* is smaller than the pitch P2 of the first main stirring conveyor blade 23*d* disposed on the small diameter shaft portion 22*a*. Thus, the developer conveyance speed of the large diameter shaft portion 22*b* is slower that of the small diameter shaft portion 22*a*.

Accordingly, the developer conveyance speed difference between the large diameter shaft portion 22*b* and the small diameter shaft portion 22*a* facilitates for the developer raised up by the second stirring chamber 7 to stay in the range corresponding to the upward inflow section E1. As a result, in the image forming apparatus U according to Example 1, it is possible to sufficiently ensure a developer amount in the range where the upward inflow section E1 overlaps with the rear end portion of the developing roller R0. Thus, at the time of image forming process, it is possible to reduce such a phenomenon that developer is not conveyed to the rear end portion of the developing roller R0 in the upward direction and the so-called shortage of the developer occurs. That is, in the image forming apparatus U according to Example 1, size of the image forming apparatus U in the X axial direction is decreased by overlapping the upward inflow section E1 with the rear end portion of the developing roller R0. Also, it is possible to reduce occurrence of image quality deterioration such as omission of images or shortage of developer density in the rear end portion of the developing roller R0.

EXAMPLE 2

Figure 8A:
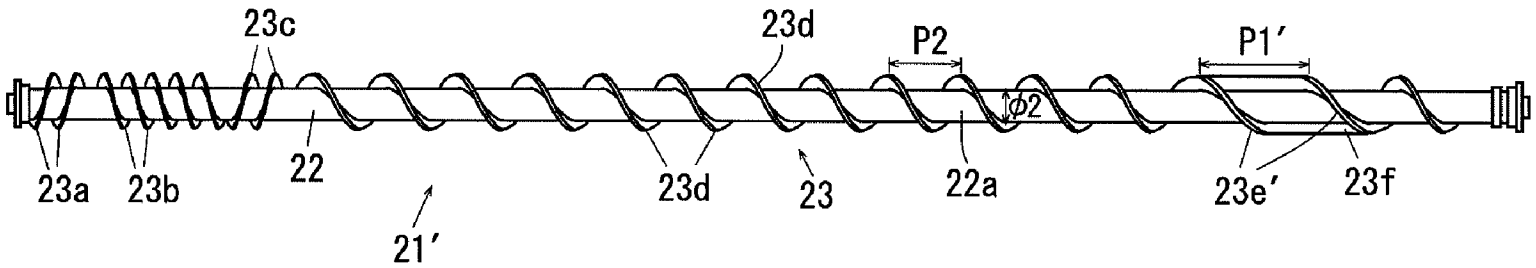
FIG. 8A is an enlarged view illustrating the main portion thereof and corresponding to FIG. 4B in Example 1.
Figure 8B:
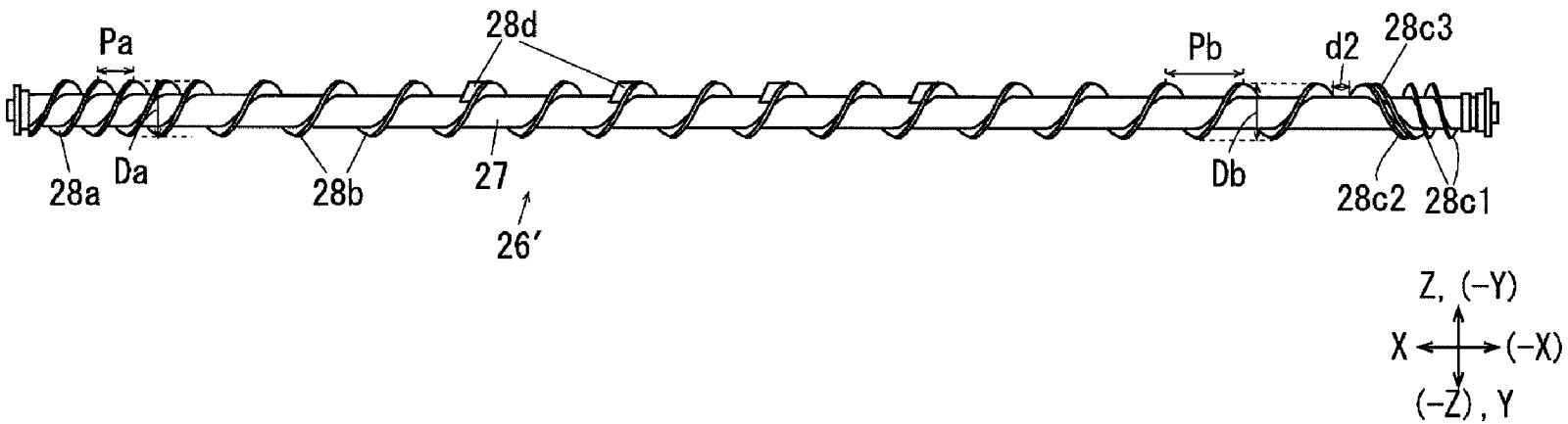
FIG. 8B is an explanatory diagram corresponding to FIG. 4C in Example 1.

FIG. 8 is an explanatory diagram illustrating a developing device according to Example 2 of the invention. FIG. 8A is an enlarged view illustrating a main portion corresponding to FIG. 4B in Example 1. FIG. 8B is an explanatory diagram corresponding to FIG. 4C in Example 1.

Next, an image forming apparatus according to Example 2 of the invention will be described. In the following description of Example 2, same reference numerals will be assigned to components corresponding to those of Example 1 and detailed description thereof will be omitted. Example 2 is different from Example 1 mentioned above in the following configurations, but the other configurations are similar to Example 1.

In FIG. 8A, a feeding auger 21' according to Example 2 of the invention is configured to omit the large diameter shaft portion 22*b* of the first rotation shaft 22 and to entirely have a diameter $\phi 2$, as compared with the feeding auger 21 according to Example 1. In the first conveyor blade 23, a large tilt-angle conveyor blade 23*e'* is disposed in the range where the upward inflow section E1 overlaps with the rear end portion of the developing roller R0, instead of the speed-reduction conveyor blade 23*e*. The large tilt-angle conveyor blade 23*e'* is configured to have a pitch P1 larger than a pitch P2 of the first main stirring conveyor blade 23*d* and has a large tilt angle, which is defined as an inclination with respect to a direction (the Z axial direction) perpendicular to the axial direction (the X axial direction).

In FIG. 8A, a planar stirring blade 23*f* is formed on the first rotation shaft 22 along the axial direction in a range from the front end of the large tilt-angle conveyor blade 23*e'* to the rear end thereof. The stirring blades 23*f* extend in a radius direction in positions which are shifted by 180° in a circumferential direction of a cylindrical surface of the first rotation shaft 22. In addition, the number and arrangement positions of the stirring blade 23*f* are not limited to two blades and 180°. It is possible to optionally employ only one blade, three blades and 120°, four blades and 90°, five blades and 72°, and six blades and 60°. In addition, an extending direction of the stirring blade 23*f* is not limited to the axial direction (the X axial direction). It is possible to incline the extending direction from the axial direction (the X axial direction) of the first rotation shaft 22. In this case, a conveyance force in the axial direction (the X axial direction) of the first rotation shaft 22 is given while a conveyance force in the vertical direction (the Z axial direction) increases. However, if a tilt angle with respect to the axial direction is set smaller than a tilt angle of the large tilt-angle conveyor blade 23*e'*, it is possible to reduce the developer conveyance speed as compared with the case where only the large tilt-angle conveyor blade 23*e'* is provided. In addition, a range of the stirring blade 23*f* is not limited to the range from the front end of the large tilt-angle conveyor blade 23*e'* to the rear end thereof. It is possible to decrease the range or increase the range up to the range of the first main stirring conveyor blade 23*d*.

In FIG. 8B, in the stirring auger 26' according to Example 2 of the invention, the backward-direction conveyor blade 28*c* of the second conveyor blade 28 is configured so that a third backward-direction conveyor blade 28*c*3 having 14 mm in pitch and having ½ in number of turns is disposed on an adjacent position in the rear direction (the −X direction) of the second backward-direction conveyor blade 28*c*2. That is, in Example 2, the second backward-direction conveyor blade 28*c*2 and third backward-direction conveyor blade 28*c*3 of the backward-direction conveyor blade 28*c* are formed in a so-called double helical shape.

(Effect of Example 2)

In the image forming apparatus U according to Example 2 having the above configuration, the stirring auger 26' is configured so that the second backward-direction conveyor blade 28*c*2 and the third backward-direction conveyor blade 28*c*3 of the backward-direction conveyor blade 28*c* are formed in the double helical shape. Thus, as compared with the backward-direction conveyor blade 28*c* according to Example 1, it is possible to increase the force (the blocking force) that the backward-direction conveyor blade 28*c* pushes back developer to the rear end of the upward inflow section E1. Accordingly, in the image forming apparatus according to Example 2, it is possible to further increase the force that the backward-direction conveyor blade 28*c* pushes back the developer to the rear end of the upward inflow section E1.

In the image forming apparatus U according to Example 2, the angle of the large tilt-angle conveyor blade 23*e'* is large. Thus, it becomes easy to give a force in the upward direction (the −Z direction) to the developer conveyed when the feeding auger 21' is rotated. Accordingly, in the image forming apparatus U according to Example 2, the large tilt-angle conveyor blade 23*e'* can help to easily supply (easily collect) the developer raised up from the second stirring chamber 7 to the rear end portion of the developing roller R0 in the obliquely upward direction.

In the image forming apparatus U according to Example 2, the stirring blades 23*f* are disposed in the range from the front end of the large tilt-angle conveyor blade 23*e'* to the rear end thereof. The stirring blades 23*f* stir the developer in the range of the large tilt-angle conveyor blade 23*e'*, so that the conveyance force is not given to the developer. Thus, it is possible to reduce the developer conveyance speed in the range of the large tilt-angle conveyor blade 23*e'*. Accordingly, in the image forming apparatus U according to Example 2, the large tilt-angle conveyor blade 23*e'* can prevent too much developer from being conveyed. Thus, it is possible to reduce the occurrence of shortage of developer in the rear end portion of the developing roller R0. As a result, the image forming apparatus U according to Example 2 has the same effect as the image forming apparatus U according to Example 1.

EXAMPLE 3

Figure 9A:
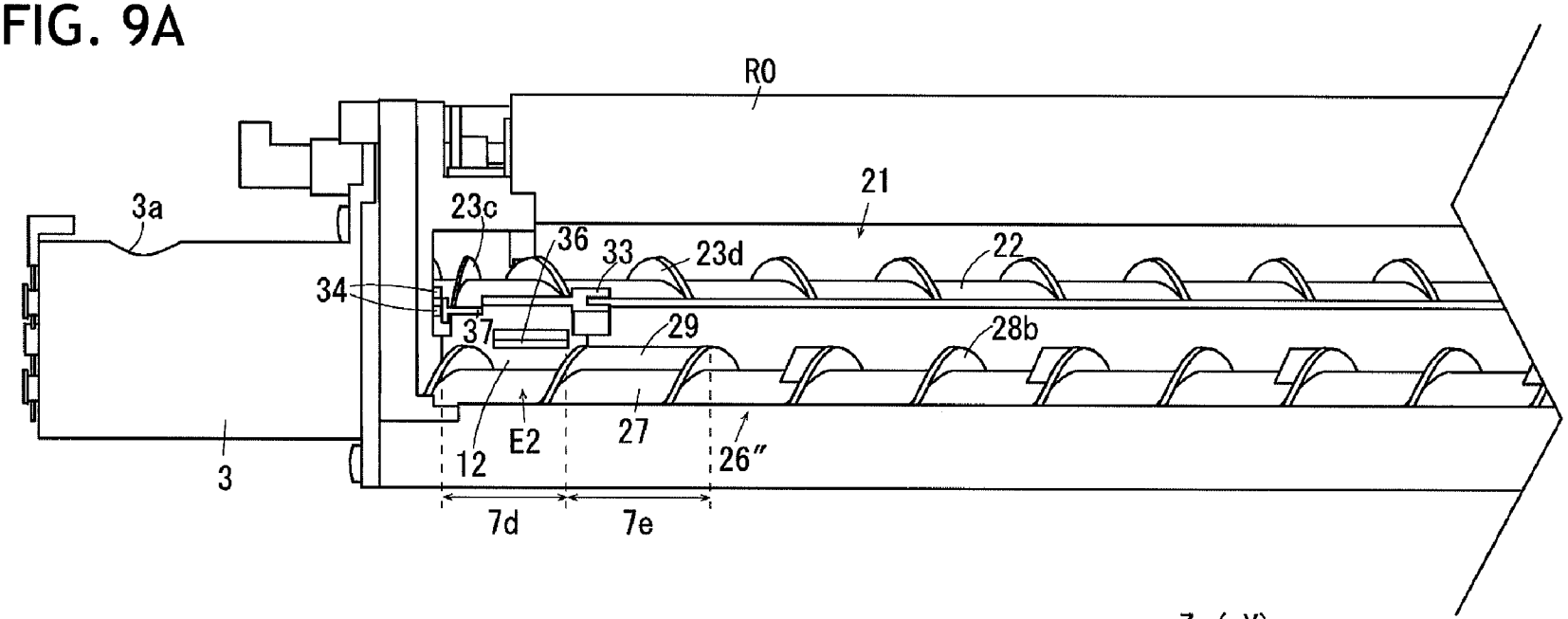
FIG. 9A is an enlarged view illustrating a main portion and corresponding to FIG. 5 in Example 1.
Figure 9B:
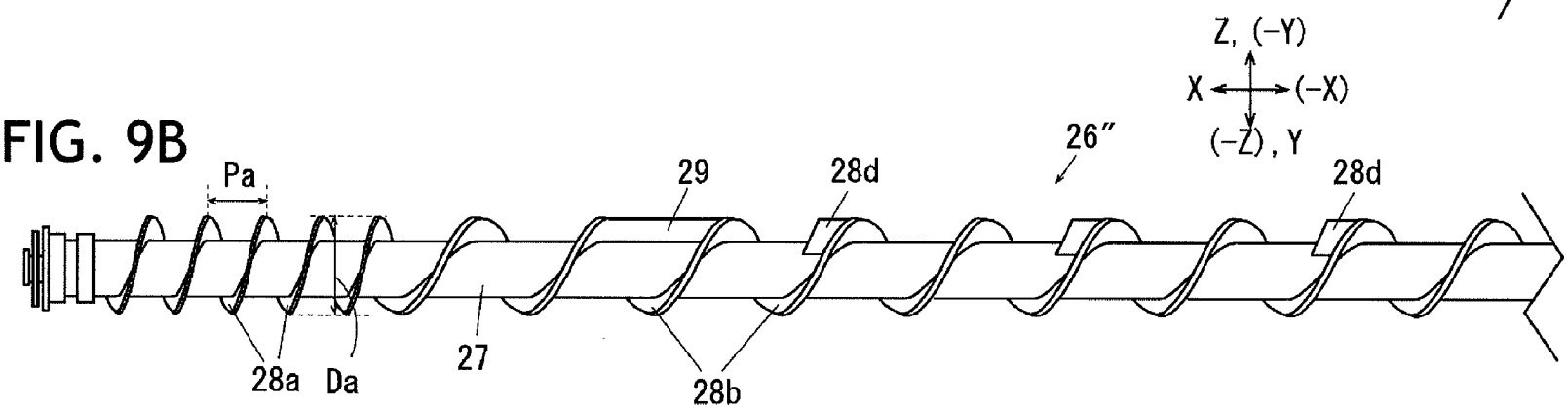
FIG. 9B is an explanatory diagram corresponding to FIG. 4C in Example 1.

FIG. 9 is an explanatory diagram illustrating a developing device according to Example 3 of the invention. FIG. 9A is an enlarged view illustrating a main portion corresponding to FIG. 5 in Example 1. FIG. 9B is an explanatory diagram corresponding to FIG. 4C in Example 1.

Next, an image forming apparatus according to Example 3 of the invention will be described. In the following description of Example 3, the same reference numerals will be assigned to components corresponding to those of Example 1 and detailed description thereof will be omitted. Example 3 is different from Example 1 mentioned above in the following configurations, but the other configurations are similar to Example 1.

In FIG. 9, in the second stirring chamber 7 of the developing devices Gy to Gk according to Example 3 of the invention, a conveyance speed reduction area 7*e* is provided on the downstream side, in the second developer conveyance direction Ya, of a second stirring chamber inflow area 7*d* in which developer flows from the downward inflow section E2.

In a stirring auger 26" according to Example 3, a stirring member 29 formed in a planar shape along the axial direction as an example of a conveyance speed reduction member is supported in a position corresponding to the conveyance speed reduction area 7*e* of the second rotation shaft 27. In Example 3, V denotes a developer conveyance speed in the conveyance speed reduction area 7*e*, and $V_{max}$ denotes the maximum developer conveyance speed in the downstream side of the conveyance speed reduction area 7*e*. In this case, Example 3 is configured so as to satisfy $0<V<(0.5\times V_{max})$. Also, in Example 3, Q denotes an average speed of the developer passing through a unit cross-section area in the conveyance speed reduction area 7*e*, that is, an average fluid speed per unit cross-section area, and $Q_0$ denotes an average fluid speed per unit cross-section area when the developer flows in the upward inflow section E1. In this case, Example 3 is configured so as to satisfy $Q<Q_0$.

(Effect of Example 3)

In the image forming apparatus U according to Example 3 having the above configuration, the stirring member 29 of the stirring auger 26" stirs the developer in the conveyance speed reduction area 7*e* with the developer not receiving the conveying force in the second developer conveyance direction Ya. That is, the developer conveyance speed in the conveyance speed reduction area 7*e* is reduced, and sometimes, the developer may stay on the upstream side of the conveyance speed reduction area 7*e*. If the developer stays in the range up to the second stirring chamber inflow area 7*d* on the upstream side, it is hard to flow the developer from the first opening portion 36 into the second stirring chamber 7 and an inflow amount of the developer is regulated. Accordingly, the image forming apparatus U according to Example 3 can be configured so that the developer of the first stirring chamber 6 is hard to flow into the second stirring chamber 7. In addition, the developer regulated not to flow from the first opening 36 stays in the first stirring chamber 6, and is discharged from the developer outlet 3*b* little by little. Accordingly, in the image forming apparatus U according to Example 3, it is possible to easily exchange developer.

In addition, the image forming apparatus U according to Example 3 has the same effect as the image forming apparatus U according to Examples 1 and 2.

EXAMPLE 4

Figure 10A:
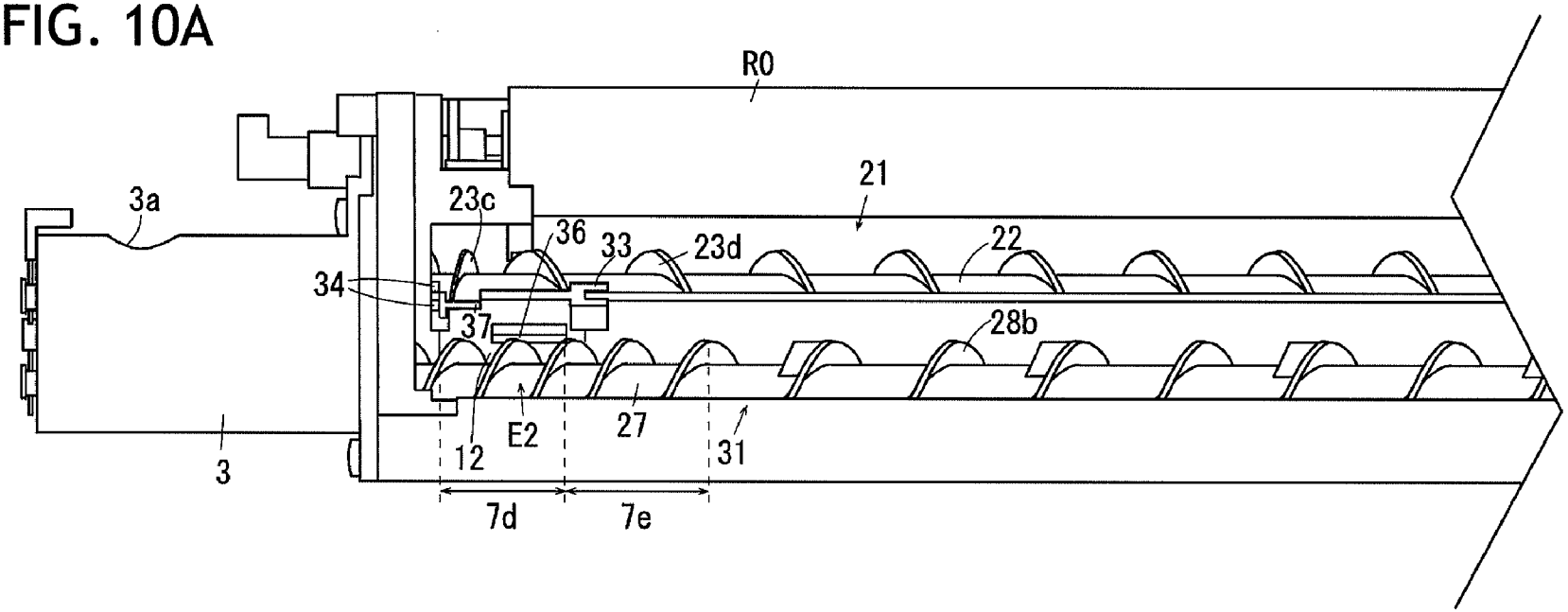
FIG. 10A is an enlarged view corresponding to FIG. 9A in Example 3.
Figure 10B:
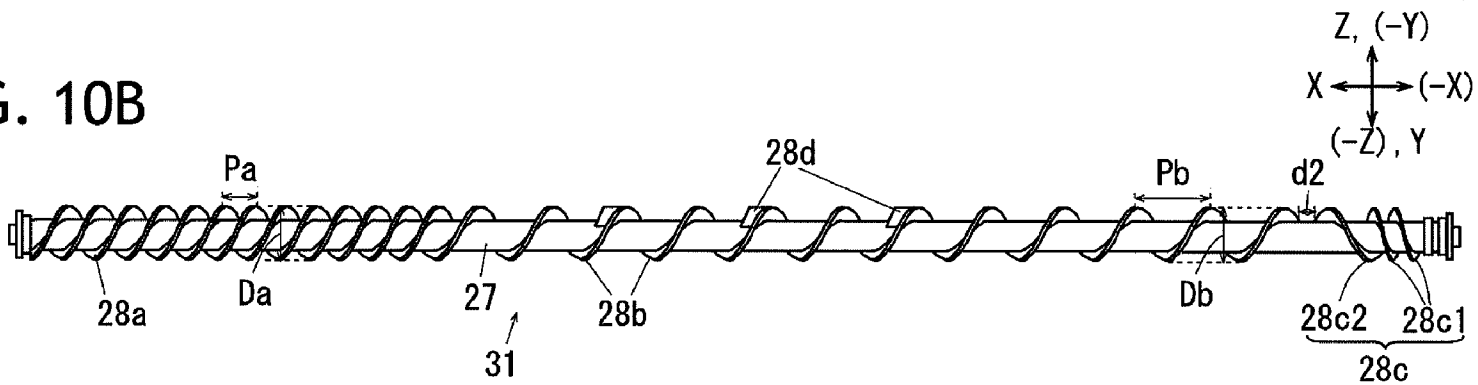
FIG. 10B is an explanatory diagram corresponding to FIG. 4C in Example 1.

FIG. 10 is an explanatory diagram illustrating the developing according to Example 4 of the invention. FIG. 10A is an enlarged view corresponding to FIG. 9A in Example 3. FIG. 10B is an explanatory diagram corresponding to FIG. 4C in Example 1.

Next, an image forming apparatus according to Example 4 of the invention will be described. In the following description of Example 4, the same reference numerals will be assigned to components corresponding to those of Example 3 and detailed description thereof will be omitted. Example 4 is different from Example 3 mentioned above in the following configurations, but the other configurations are similar to Example 3.

In FIG. 10, in a stirring auger 31 according to Example 4 of the invention, the stirring member 29 is omitted as compared with the stirring auger 26 according to Example 3. A replenishing conveyor blade 28*a* of the stirring auger 31 is formed to extend in a range from the second stirring chamber inflow area 7*d* of the second rotation shaft 27 to the conveyance speed reduction area 7*e*.

Also, in the range where the stirring member 28*d* is not formed, forces that blades 28*a*, 28*b*, and 28*c* of the second conveyor blade 28 in the stirring auger 31 convey developer can be expressed by multiplying a pitch thereof by conveyable areas of the blades 28*a*, 28*b* and 28*c* in section. In Example 4, Da denotes the conveyable area of the replenishing conveyor blade 28*a* in section, Pa denotes a pitch thereof, Db denotes an average vale of a section area of the second main stirring conveyor blade 28*b* in the range of the upward inflow section E1, and Pb denotes a pitch thereof. In this case, Example 4 is configured so as to satisfy $(Da\times Pa)<(Db\times Pb)$. That is, in the second stirring chamber 7, the developer conveyance speeds in the second stirring chamber inflow area 7*d* and the conveyance speed reduction area 7*e* are set slower than an average developer conveyance speed in the inclined surface 7*b*.

(Effect of Example 4)

In the image forming apparatus U according to Example 4 having the above configuration, the replenishing conveyor blade 28*a* of the stirring auger 31 causes the developer conveyance speeds in the second stirring chamber inflow area 7*d* and the conveyance speed reduction area 7*e* to be slower than the developer conveyance speed in the range (which includes inclined surface 7*b*) that is on a more downstream side than the conveyance speed reduction area 7*e*. Accordingly, when overflowing developer flows into the downward inflow section E2, the developer easily stays in the range from the conveyance speed reduction area 7*e* to the upstream side thereof. Since the developer stays in the range up to the second stirring chamber inflow area 7*d* on the upstream side, it is hard to flow the developer from the first opening portion 36 into the second stirring chamber 7 and the inflow amount of the developer is regulated. Accordingly, the image forming apparatus U according to Example 4 has the same effect as the image forming apparatus U according to Example 3.

In addition, the image forming apparatus U according to Example 4 has the same effect as the image forming apparatus U according to Examples 1 and 2.

EXAMPLE 5

Figure 11:
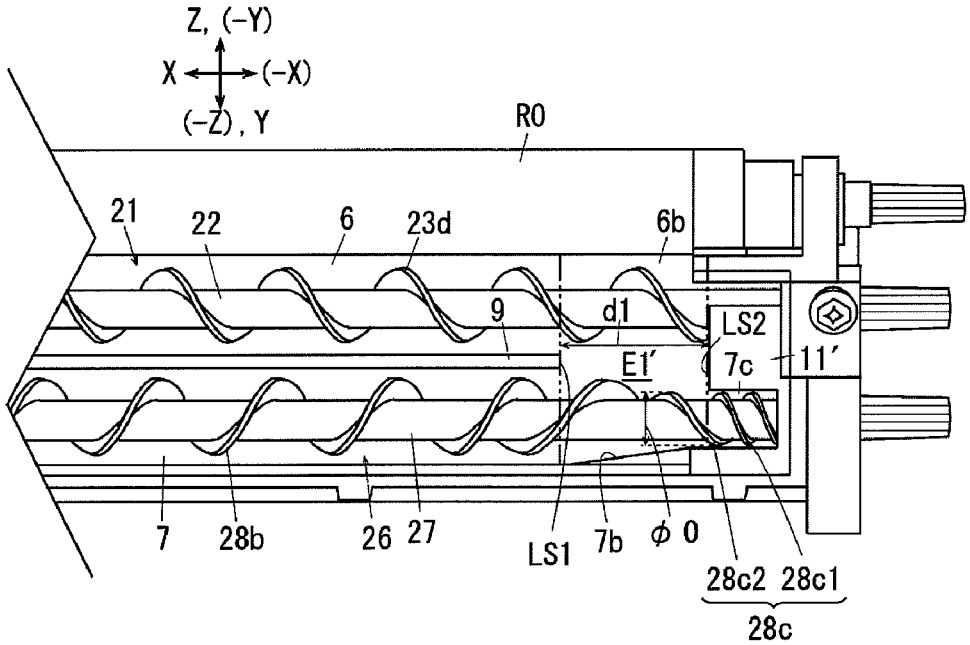
FIG. 11 is an explanatory diagram illustrating a developing device according to Example 5 of the invention and is a perspective view illustrating the main portion thereof and corresponding to FIG. 6A in Example 1.

FIG. 11 is an explanatory diagram illustrating a developing device according to Example 5 of the invention and is a perspective view illustrating a main portion corresponding to FIG. 6A in Example 1.

Next, an image forming apparatus according to Example 5 of the invention will be described. In the following description of Example 5, the same reference numerals will be assigned to components corresponding to those of Example 1 and detailed description thereof will be omitted. Example 5 is different from Example 1 mentioned above in the following configurations, but the other configurations are similar to Example 1.

In FIG. 11, in a rear end partition wall 11' according to Example 5 of the invention, the front end portion thereof is formed to be more backward (the −X direction) than the rear end of the image forming region. The rear end of the upward inflow section E1' according to Example 5 is configured to be more backward (the −X direction) than the rear end of the image forming region. In Example 5, the second backward-direction conveyor blade 28*c*2 is disposed up to the range where the upward inflow section E1' overlaps with the image forming region.

(Effect of Example 5)

In the image forming apparatus U according to Example 5 having the above configuration, the second backward-direction conveyor blade 28*c*2 is disposed up to the range where the upward inflow section E1' overlaps with the image forming region. Thus, when the stirring auger 26 is rotated, the developer in the upward inflow section E1 can be raised up to the first stirring chamber 6 by the second backward-direction conveyor blade 28*c*2. In the image forming apparatus U according to Example 5, inclination of the second backward-direction conveyor blade 28*c*2 is large. Thus, it is possible to increase a force that the second backward-direction conveyor blade 28*c*2 raises up the developer. In the image forming apparatus U according to Example 5, the rear end of the upward inflow section E1' is set to be more backward (the −X direction) than the rear end of the image forming region. Thus, it is possible to easily and widely spread the developer raised up by the second backward-direction conveyor blade 28*c*2 over the rear end of the image forming region, so that it is possible to reduce density unevenness (density deterioration) in the end portion in the axial direction. In addition, the image forming apparatus U according to Example 5 has the same effect as the image forming apparatus U according to Example 1.

Modified Example

As described above, the examples of the invention has been described in detail. However, the invention is not limited to the examples mentioned above, and may be modified in various ways without departing from the technical spirit of the invention described in claims.

Modified examples (H01) to (H05) of the invention will be described below.

(H01) in the examples mentioned above, a copier is employed as an example of the image forming apparatus, but the invention is not limited thereto. The invention may be applied to a FAX, a printer, or a multi-function printer having all functions of those or plural functions. In addition, the invention is not limited to a full-color image forming apparatus. The invention may be applied to an image forming apparatus having a single color, that is, a so-called monochrome image forming apparatus.

(H02) in the examples, the feeding augers 21 and 21' and the stirring augers 26, 26', 26", and 31 are formed to have a rotation shaft and a blade, that is, a so-called auger. However, the invention is not limited thereto. A helical shape, that is, so-called agitator may be employed.

(H03) in the examples, the above-mentioned values may be optionally modified in accordance with design or specification.

(H04) in the examples, there is provided a configuration that the first opening portion and the second opening portion are formed in the opening forming member 12 and the opening forming member 12 is mounted on the downward inflow section E2. However, the invention is not limited thereto. For example, the first opening portion and the second opening portion may be formed by making a hole through the partition wall or a shape of the partition wall itself may be used as a shape having the first opening portion and the second opening portion.

(H05) in the image forming apparatus U according to the examples, the two component developer including toner and carrier is employed, and the developing devices Gy, Gm, Gc, and Gk have the developer supply/disposal vessel 3 including the developer replenishing port 3*a* for replenishing developer from the developer cassettes Ky, Km, Kc, and Kk and the developer outlet 3*b* for collecting the wasted developer in the developer collecting container, in order to gradually exchange deteriorated developer. However, the invention is not limited thereto. The invention may be applied to developing devices Gy, Gm, Gc, and Gk in which the developer supply/disposal vessel 3 is not employed and thus developer is not exchanged.

What is claimed is:

1. A developing device comprising:

a developer carrier that rotates while carrying a developer on a surface thereof;

a first developer containing chamber that contains the developer to be supplied to the developer carrier;

a second developer containing chamber that has a bottom face disposed at a position lower, in a gravitational direction, than a bottom face of the first developer containing chamber;

a first inflow section that allows the developer to flow from the second developer containing chamber into the first developer containing chamber;

a second inflow section that allows the developer to flow from the first developer containing chamber into the second developer containing chamber;

a first conveyance member that is disposed in the first developer containing chamber and conveys the developer contained in the first developer containing chamber in a first developer conveyance direction going from the first inflow section toward the second inflow section; and a second conveyance member that is disposed in the second developer containing chamber and conveys the developer contained in the second developer containing chamber in a second developer conveyance direction going from the second inflow section toward the first inflow section, wherein the second developer containing chamber is formed so that in a range corresponding to the first inflow section, an area of a cross section, perpendicular to the second developer conveyance direction, of the second developer containing chamber decreases along the second developer conveyance direction, wherein the second developer containing chamber includes an inclination portion that is formed in the range corresponding to the first inflow section, the inclination portion is inclined so that the bottom face of the second developer containing chamber becomes higher along the second developer conveyance direction.

2. The developing device according to claim 1, wherein:

the first inflow section extends along an axial direction of the developer carrier, the first inflow section is disposed so as to correspond to a range overlapping with an image forming region in which an image is developed with the developer carried on the surface of the developer carrier, and the second developer containing chamber is formed so that at least in a range where the first inflow section overlaps with the image forming region, the area of the cross section, perpendicular to the second developer conveyance direction, of the second developer containing chamber decreases along the second developer conveyance direction.

3. The developing device according to claim 2, wherein the second developer containing chamber has a conveyance speed reduction area disposed in a vicinity of the second inflow section, and in the conveyance speed reduction area, a conveyance speed of the developer is locally reduced as compared with other areas.

4. The developing device according to claim 3, wherein the second conveyance member comprises a rotation shaft, and a helical conveyor blade that is formed in a helical shape, is supported by the rotation shaft, and conveys the developer contained in the second developer containing chamber in the second developer conveyance direction, and an outer diameter of the helical conveyor blade in the range corresponding to the first inflow section is smaller than that of the helical conveyor blade in a range corresponding to an upstream side of the first inflow section in the second developer conveyance direction, and the conveyance speed, in the second developer conveyance direction, of the developer in the range corresponding to the first inflow section is faster than that in the conveyance speed reduction area.

5. An image carrier unit comprising:

an image carrier that carries a latent image formed on a surface thereof; and the developing device according to claim 1, that develops the latent image formed on the image carrier surface into a visible image.

6. An image forming apparatus comprising:

an image carrier that carries a latent image formed on a surface thereof;

the developing device according to claim 1, that develops the latent image formed on the image carrier surface into a visible image; and a transfer device that transfers the visible image formed on the surface of the image carrier to a medium.

7. A developing device comprising:

a developer carrier that rotates while carrying a developer on a surface thereof;

a first developer containing chamber that contains the developer to be supplied to the developer carrier;

a second developer containing chamber that has a bottom face disposed at a position lower, in a gravitational direction, than a bottom face of the first developer containing chamber;

a first inflow section that allows the developer to flow from the second developer containing chamber into the first developer containing chamber;

a second inflow section that allows the developer to flow from the first developer containing chamber into the second developer containing chamber;

a first conveyance member that is disposed in the first developer containing chamber and conveys the developer contained in the first developer containing chamber in a first developer conveyance direction going from the first inflow section toward the second inflow section; and a second conveyance member that is disposed in the second developer containing chamber and conveys the developer contained in the second developer containing chamber in a second developer conveyance direction going from the second inflow section toward the first inflow section, wherein the second developer containing chamber is formed so that in a range corresponding to the first inflow section, an area of a cross section, perpendicular to the second developer conveyance direction, of the second developer containing chamber decreases along the second developer conveyance direction, wherein the first inflow section extends along an axial direction of the developer carrier, the first inflow section is disposed so as to correspond to a range overlapping with an image forming region in which an image is developed with the developer carried on the surface of the developer carrier, and the second developer containing chamber is formed so that at least in a range where the first inflow section overlaps with the image forming region, the area of the cross section, perpendicular to the second developer conveyance direction, of the second developer containing chamber decreases along the second developer conveyance direction.

8. The developing device according to claim 7, wherein the second developer containing chamber has a conveyance speed reduction area disposed in a vicinity of the second inflow section, and in the conveyance speed reduction area, a conveyance speed of the developer is locally reduced as compared with other areas.

9. The developing device according to claim 8, wherein the second conveyance member comprises a rotation shaft, and a helical conveyor blade that is formed in a helical shape, is supported by the rotation shaft, and conveys the developer contained in the second developer containing chamber in the second developer conveyance direction, and an outer diameter of the helical conveyor blade in the range corresponding to the first inflow section is smaller than that of the helical conveyor blade in a range corresponding to an upstream side of the first inflow section in the second developer conveyance direction, and the conveyance speed, in the second developer conveyance direction, of the developer in the range corresponding to the first inflow section is faster than that in the conveyance speed reduction area.

10. An image carrier unit comprising:

an image carrier that carries a latent image formed on a surface thereof; and the developing device according to claim 7, that develops the latent image formed on the image carrier surface into a visible image.

11. An image forming apparatus comprising:

an image carrier that carries a latent image formed on a surface thereof;

the developing device according to claim 7, that develops the latent image formed on the image carrier surface into a visible image; and a transfer device that transfers the visible image formed on the surface of the image carrier to a medium.

12. A developing device comprising:

a developer carrier that rotates while carrying developer on a surface thereof;

a first developer containing chamber that contains the developer to be supplied to the developer carrier;

a second developer containing chamber that has a bottom face disposed at a position lower than a bottom face of the first developer containing chamber in a gravitational direction;

a first inflow section that allows the developer to flow from the second developer containing chamber into the first developer containing chamber;

a second inflow section that allows the developer to flow from the first developer containing chamber into the second developer containing chamber;

a first conveyance member that is disposed in the first developer containing chamber and conveys the developer contained in the first developer containing chamber in a first developer conveyance direction going from the first inflow section toward the second inflow section; and a second conveyance member that is disposed in the second developer containing chamber and that conveys the developer contained in the second developer containing chamber in a second developer conveyance direction going from the second inflow section toward the first inflow section, wherein the second conveyance member comprises a rotation shaft, a forward-direction conveyor blade that is supported by the rotation shaft and conveys the developer contained in the second developer containing chamber in the second developer conveyance direction, and a backward-direction conveyor blade that is supported by the rotation shaft in the range corresponding to the first inflow section and in a downstream side of the range in the second developer conveyance direction, the backward-direction conveyor blade that conveys the developer in an opposite direction to the second developer conveyance direction, the backward-direction conveyor blade comprises a first backward-direction conveyor blade, and a second backward-direction conveyor blade disposed on an upstream side of the first backward-direction conveyor blade in the second developer conveyance direction, the second backward-direction conveyor blade having a larger angle with respect to a direction perpendicular to the rotation shaft than that of the first backward-direction conveyor blade, and the first backward-direction conveyor blade and the second backward-direction conveyor blade are formed consecutively.

13. The developing device according to claim 12, wherein the second backward-direction conveyor blade is formed in a double helical shape.

14. The developing device according to claim 13, wherein the first inflow section extends along an axial direction of the developer carrier, the first inflow section is disposed so as to correspond to a range overlapping with an image forming region in which an image is developed with the developer carried on the surface of the developer carrier, and the second backward-direction conveyor blade is disposed at least in a range in which the first inflow section overlaps with the image forming region.

15. The developing device according to claim 14, wherein the second developer containing chamber has a conveyance speed reduction area disposed in a vicinity of the second inflow section, and in the conveyance speed reduction area, a conveyance speed of the developer is locally reduced as compared with other areas.

16. The developing device according to claim 12, wherein the first inflow section extends along an axial direction of the developer carrier, the first inflow section is disposed so as to correspond to a range overlapping with an image forming region in which an image is developed with the developer carried on the surface of the developer carrier, and the second backward-direction conveyor blade is disposed at least in a range in which the first inflow section overlaps with the image forming region.

17. The developing device according to claim 16, wherein the second developer containing chamber has a conveyance speed reduction area disposed in a vicinity of the second inflow section, and in the conveyance speed reduction area, a conveyance speed of the developer is locally reduced as compared with other areas.

18. An image carrier unit comprising:

an image carrier that carries a latent image formed on a surface thereof; and the developing device according to claim 12, that develops the latent image formed on the image carrier surface into a visible image.

19. An image forming apparatus comprising:

an image carrier that carries a latent image formed on a surface thereof;

the developing device according to claim 12, that develops the latent image formed on the image carrier surface into a visible image; and a transfer device that transfers the visible image formed on the surface of the image carrier to a medium.

* * * * *